US010722808B2

(12) United States Patent
Jardin

(10) Patent No.: US 10,722,808 B2
(45) Date of Patent: Jul. 28, 2020

(54) NESTED COUNTERWEIGHT FOR A ROTATABLE PERFORMANCE DEVICE

(71) Applicant: Flambeau, Inc., Baraboo, WI (US)

(72) Inventor: Bryan Jardin, Orlando, FL (US)

(73) Assignee: Flambeau, Inc., Baraboo, WI (US)

( * ) Notice: Subject to any disclaimer, the term of this patent is extended or adjusted under 35 U.S.C. 154(b) by 0 days.

(21) Appl. No.: 16/154,341

(22) Filed: Oct. 8, 2018

(65) Prior Publication Data

US 2019/0105577 A1 Apr. 11, 2019

Related U.S. Application Data

(60) Provisional application No. 62/569,229, filed on Oct. 6, 2017.

(51) Int. Cl.
*A63H 1/30* (2006.01)

(52) U.S. Cl.
CPC ..... *A63H 1/30* (2013.01)

(58) Field of Classification Search
CPC . A63H 1/30; A63H 11/00; A63H 1/04; A63B 69/0079; A63F 9/16
USPC ..... 446/242, 249, 250, 251, 253, 490
See application file for complete search history.

(56) References Cited

U.S. PATENT DOCUMENTS 93,249 A * 8/1869 Trebe
2,161,154 A * 6/1939 Gertler ..... A63H 1/32 446/253
2,252,678 A * 8/1941 Beary ..... G09B 19/0023 434/98
2,278,894 A * 4/1942 Paulson ..... A63H 33/088 446/117
3,687,453 A * 8/1972 Fraga ..... A63B 67/22 473/508
3,794,323 A * 2/1974 Johnson ..... A63B 67/22 473/508
3,850,429 A * 11/1974 Clifford ..... A47D 13/00 482/122
4,488,373 A * 12/1984 Glickson ..... A63H 33/103 446/4
6,371,824 B1 * 4/2002 Brown ..... A63H 1/30 446/250
7,137,863 B2 * 11/2006 Hiebert ..... A63B 67/16 446/490
8,851,954 B2 * 10/2014 McCafferty ..... A63H 1/30 446/250
9,004,978 B2 * 4/2015 Shaw ..... A63H 33/00 446/247
D728,695 S * 5/2015 Chase ..... D21/471
2015/0367244 A1 * 12/2015 Paul ..... A63H 33/002 446/242

* cited by examiner

*Primary Examiner* — Nini F Legesse
(74) *Attorney, Agent, or Firm* — Quarles & Brady LLP

(57) ABSTRACT

A nested counterweight for a rotatable performance device includes an outer housing and an inner slider. The outer housing defines an interior volume and is configured to be positioned along a string of the rotatable performance device. The inner slider is also configured to be positioned along the string of the rotatable performance device. The inner slider is positioned within the interior volume on the outer housing in a nested configuration. The inner slider is positioned along the string away from the outer housing in a separated configuration.

26 Claims, 8 Drawing Sheets

NESTED COUNTERWEIGHT FOR A ROTATABLE PERFORMANCE DEVICE

CROSS REFERENCE TO RELATED APPLICATIONS

This application claims priority to U.S. Provisional Patent Application No. 62/569,229 filed on Oct. 6, 2017, the entire contents of which are incorporated herein by reference.

BACKGROUND

The present invention relates to nested counterweights for rotatable performance devices. More specifically, a yo-yo having a nested counterweight is disclosed that is selectively configurable to vary "play" characteristics of the device.

Rotatable performance devices, such as diabolos, yo-yos, and the like, are well-known entertainment devices for performing maneuvers or tricks. Yo-yos include a string that engages an axle of the device, and the string is initially wound around the axle and connected to a user's finger. The yo-yo is "thrown down" to cause two halves or lobes of the yo-yo to spin relative to the string. After the lobes begin spinning or "sleeping" at the end of the string, the user may perform maneuvers such as "walking the dog", swinging the yo-yo "around the world", and the like.

Attaching a solid body to act as a counterweight to an end of the string that is traditionally attached to a user's finger enables the user to perform additional maneuvers or tricks. During use, the user may selectively release and hold the solid body while the yo-yo is spinning to perform different tricks. Maneuvers such as supporting the yo-yo by holding the string between the solid body and the yo-yo while moving the yo-yo and/or the solid body with respect to the support point are possible.

More maneuvers are possible by adding a second solid body to the string that is configured to slide along the length of the string. However, gripping two solid bodies in the user's hand when performing tricks that don't require the counterweights may be uncomfortable. Further, users with smaller hands (i.e., a young child or teen) may have difficulty controlling a yo-yo with two counterweights attached because the user's hands are small.

Therefore, there is a need for a counterweight capable of being selectively configurable between a single counterweight and two separate counterweights, while at the same time allowing for easy and quick transitions between configurations. Further, the counter weight should be sized and shaped to easily fit in a user's hand comfortably.

SUMMARY

The present disclosure may overcome one or more of the aforementioned drawbacks by providing a nested counterweight that is sized and shaped to easily fit comfortably in a user's hand and transitions quickly and easily between a single counterweight configuration and a double counterweight configuration.

According to one aspect, a nested counterweight for a rotatable performance device includes an outer housing and an inner slider. The outer housing defines an interior volume and is configured to be positioned along a string of the rotatable performance device. The inner slider is also configured to be positioned along the string of the rotatable performance device. The inner slider is positioned within the interior volume on the outer housing in a nested configuration. The inner slider is positioned along the string away from the outer housing in a separated configuration.

According to another aspect, a nested counterweight for a rotatable performance device includes an outer housing and an inner slider. The outer housing is configured in a first geometric shape. The outer housing also defines an interior volume and is configured to be positioned along a string of the rotatable performance device. The inner slider is movable along the sting and configured in a second geometric shape that correlates to the first geometric shape of the outer housing so that the inner slider may be positioned within the interior volume of the outer housing in a nested configuration.

According to a further aspect, a method of using a nested counterweight with a rotatable performance device is provided. The method includes the step of providing the nested counterweight that includes an outer housing and an inner slider, both of which are configured to be positioned along a string of the rotatable performance device. The outer housing defines an interior volume configured to receive the inner slider. The method includes removing the inner slider from the outer housing to perform a first maneuver with the rotatable performance device while the nested counterweight is in a separated configuration such that the outer housing is not in contact with the inner slider.

DETAILED DESCRIPTION

Figure 1:
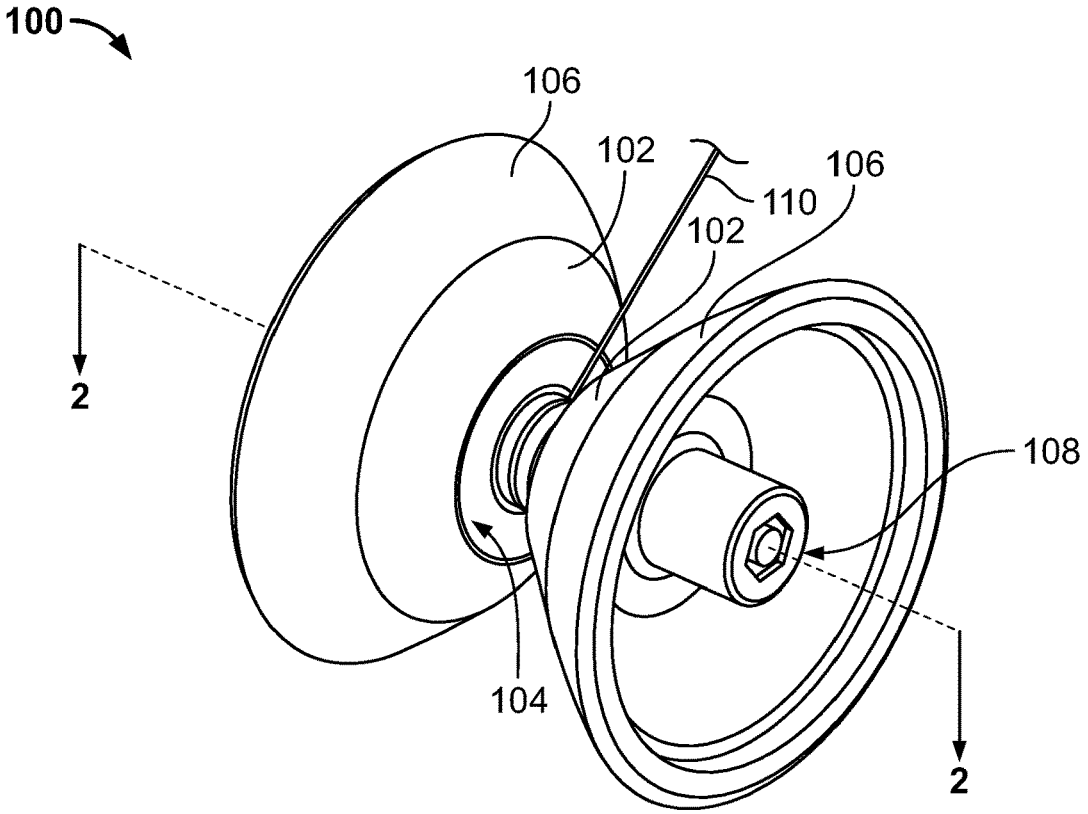
FIG. 1 is an isometric view of a rotatable performance device.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 2:
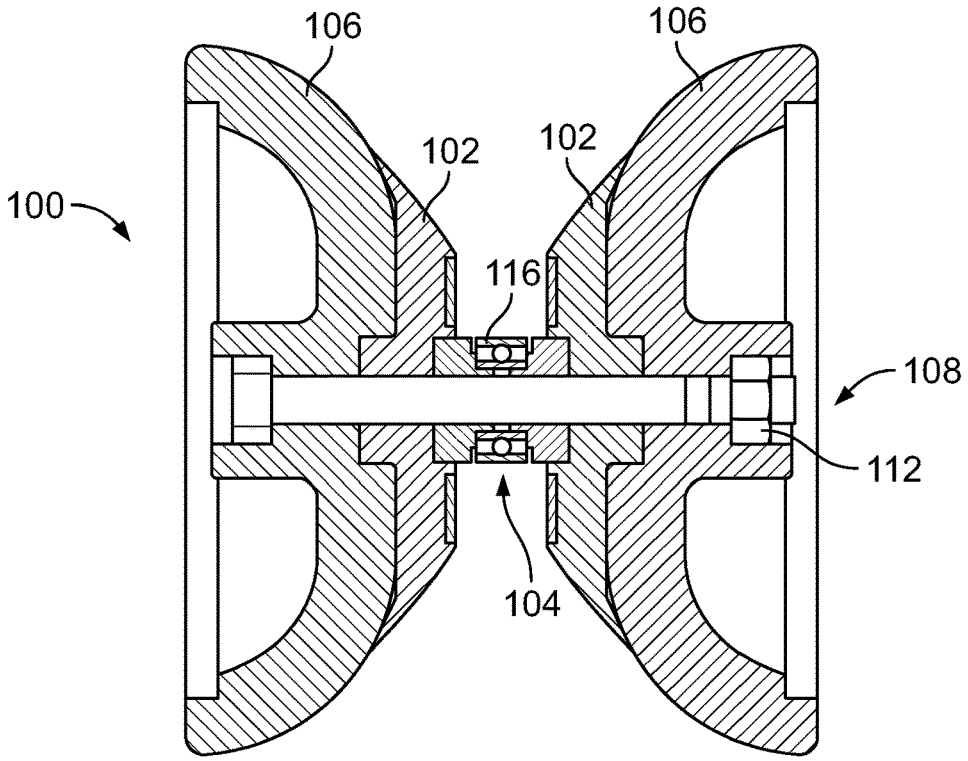
FIG. 2 is a cross-sectional view of the rotatable performance device taken along line 2-2 of FIG. 1.

Referring generally to FIGS. 1 and 2, an embodiment of a rotatable performance device, such as a yo-yo 100 is depicted. In particular, the yo-yo 100 includes inner lobe spacers 102 that are attachable and detachable from a bearing assembly 104 and rotatable outer lobes 106. The yo-yo 100 includes an axle 108 that supports the above components and provides an axis about which some components of the yo-yo 100 rotate relative to a support a tether or a string 110. In the embodiment shown in FIGS. 1 and 2, the axle 108 includes a nut 112 and a threaded bolt 114.

As depicted in FIG. 2, the axle 108 supports the bearing assembly 104 along the shaft of the bolt 114. In general, the bearing assembly 104 permits relative rotation between some components of the yo-yo 100 and the string 110. To this end, the bearing assembly 104 includes a support bearing 116 which may be any appropriate type of bearing, such as a ball bearing. The support bearing 116 is coupled to the string 110 to permit the rotating portions of the yo-yo 100 to rotate during use while an outer portion of the support bearing 116 remains stationary relative to the string 110. The yo-yo 100 is assembled as such, the nut 112 is passed through one outer lobe 106, one inner lobe spacer 102, one bearing assembly 104, another inner lobe spacer 102, and another outer lobe 106. The string 110 may be attached during assembly or may be tied onto the bearing assembly 104 at the end. The nut 112 is attached to the threaded bolt 114 and the assembly is complete.

It is contemplated that one having ordinary skill in the art would understand that many configurations beyond the yo-yo 100 depicted in FIGS. 1 and 2 are possible. Other contemplated yo-yos include a body having a central channel and an axle for attaching a string in the channel. The body is designed to rotate relative to the attachment of the string for the yo-yo to operate. It is also contemplated that the embodiments of nested counterweights disclosed herein will function with many different rotatable performance device configurations.

Figure 3:
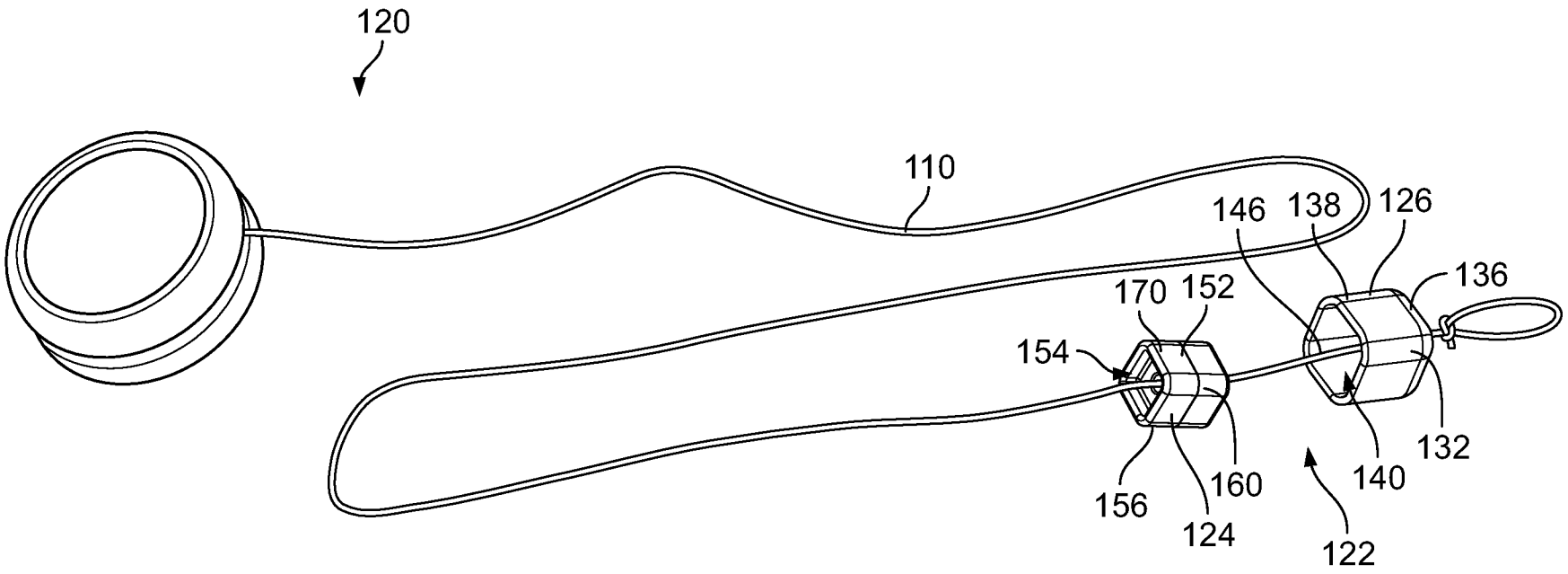
FIG. 3 is a front plan view of a rotatable performance device with a nested counterweight attached and separated.

Referring to FIG. 3, another embodiment of a yo-yo 120 is depicted with the string 110 loosely extended and a nested counterweight 122 attached. The nested counterweight 122 includes an inner slider 124 and an outer housing 126. The string 110, as described above, attaches to an axle/bearing (not shown) of the yo-yo 120 at a first end. The string 110 also passes through both the inner slider 124 and the outer housing 126 of the nested counterweight 122. A knot 128 (see FIG. 9) retains the outer housing 126 on the string 110 during use and may form a loop for placing around a finger of the user if desired.

Figure 4:
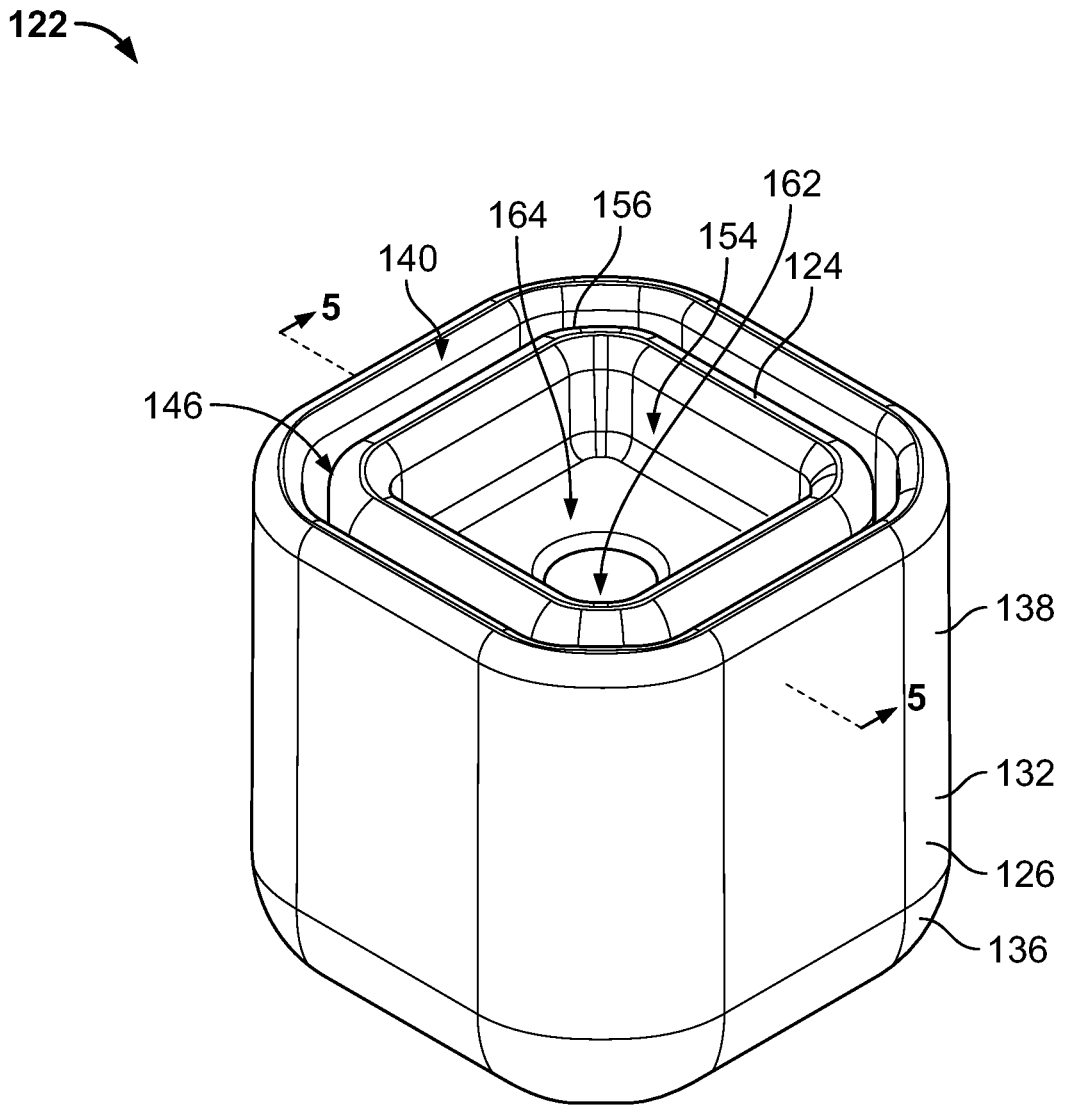
FIG. 4 is an isometric view of the nested counterweight of FIG. 3 in a first configuration.
Figure 5:
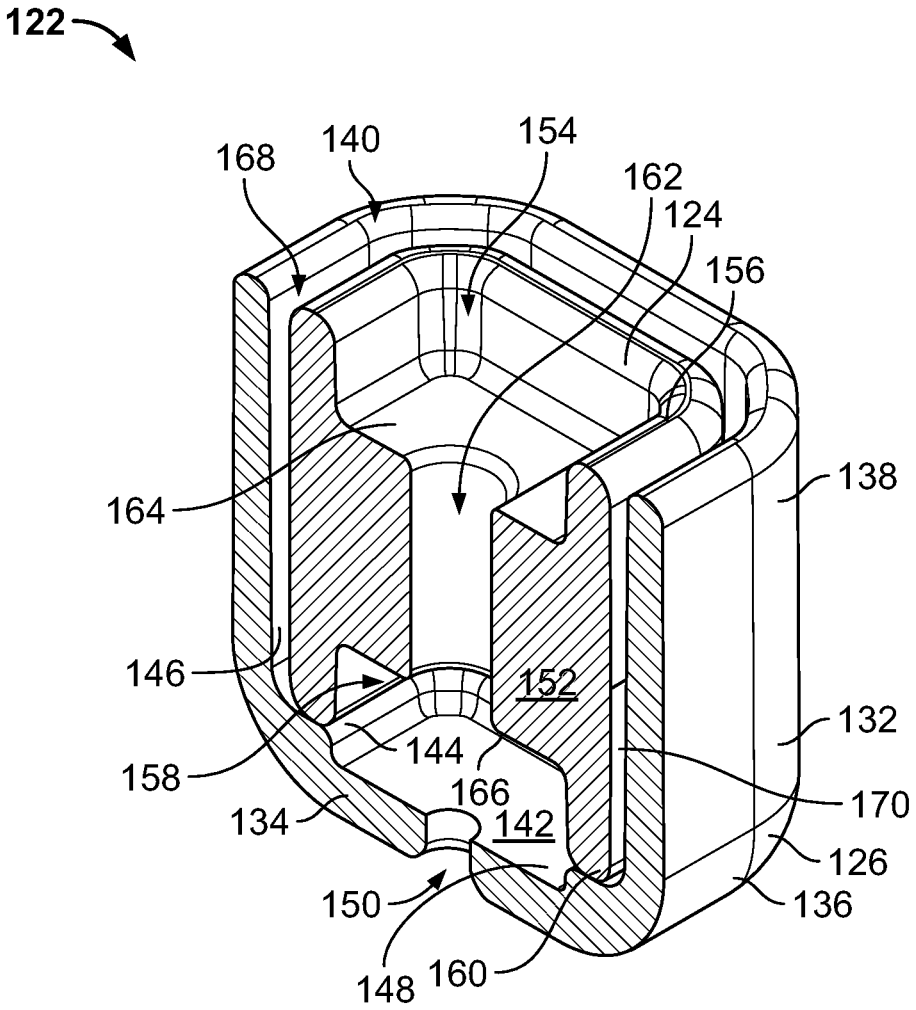
FIG. 5 is an isometric cross-sectional view of the nested counterweight of FIG. 3 in the first configuration taken along the line 5-5 of FIG. 4.
Figure 8:
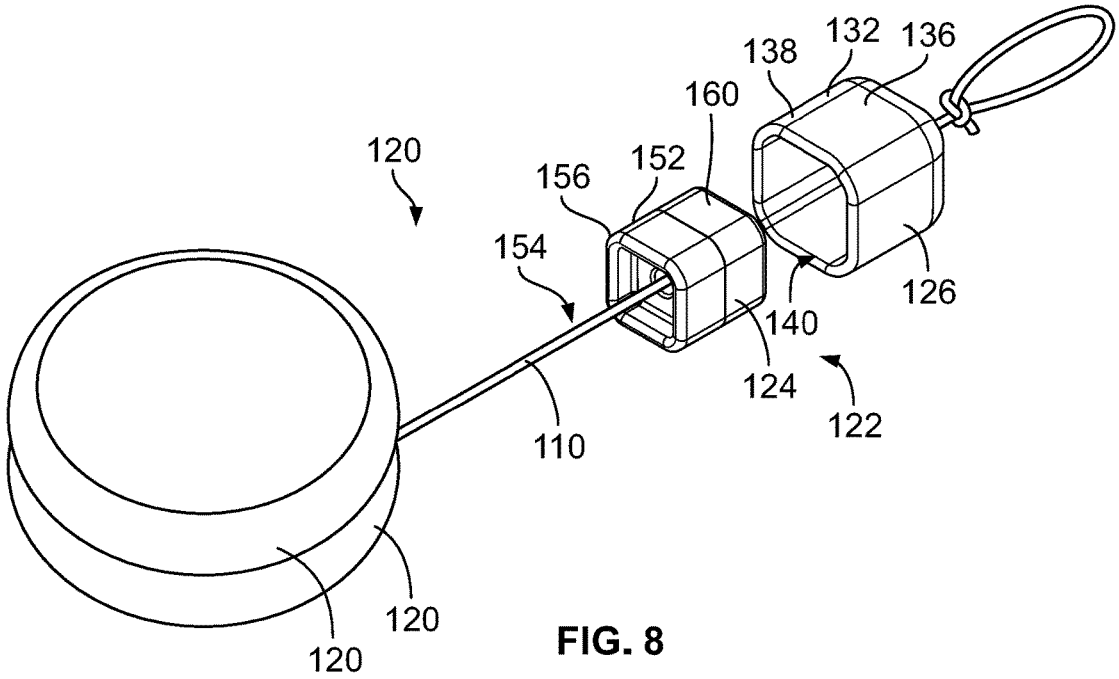
FIG. 8 is a front plan view of the rotatable performance device with the nested counterweight of FIG. 3 in a second configuration.
Figure 9:
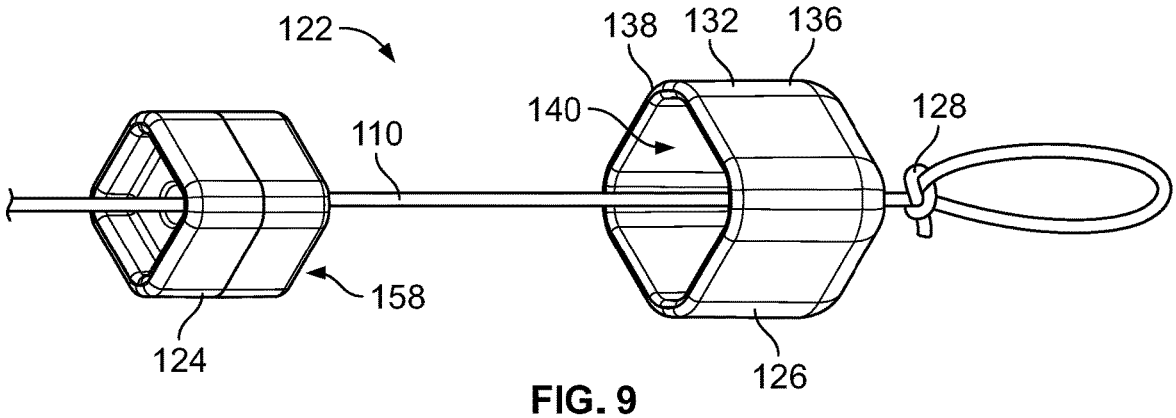
FIG. 9 is a plan view of the nested counterweight of FIG. 3 in a second configuration attached to an end of a tether.
Figure 10:
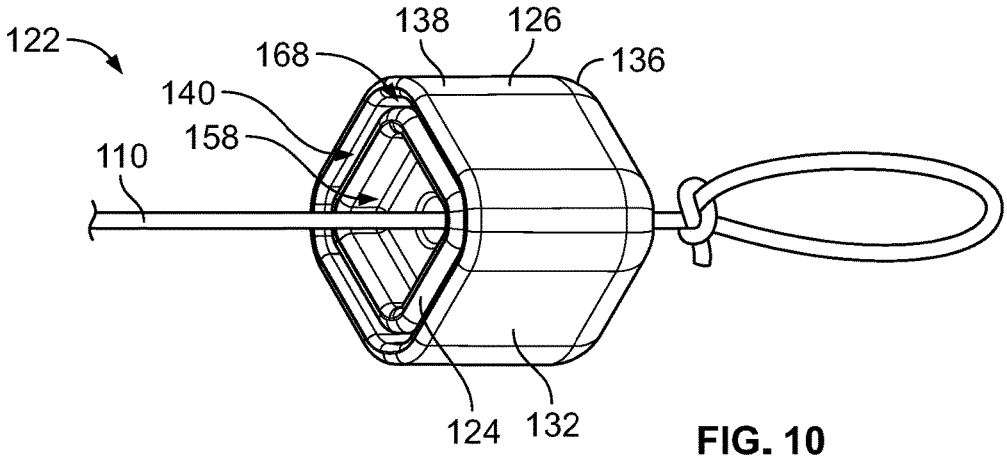
FIG. 10 is a plan view of the nested counterweight of FIG. 3 attached to the end of the tether in a first configuration.

Now referring to FIGS. 4-10, the nested counterweight 122 is configurable between a first or nested configuration as depicted in FIGS. 4, 5, and 10, and a second or separated configuration as depicted in FIGS. 3 and 6-9. In the nested configuration, the inner slider 124 is positioned within and contacts at least a portion of the outer housing 126. During use with the nested counterweight 122 in the nested configuration, the yo-yo 120 is capable of maneuvers requiring a single counterweight or no counterweight. When the user positions the inner slider 124 along the string 110 away from, and not contacting, the outer housing 126 during use in the second configuration, the yo-yo 120 is then capable of a different series of maneuvers. It is contemplated that the inner slider 124 is positionable at any location along the length of the string 110 in the separated configuration between being adjacent the outer housing 126 and the body of the yo-yo 120. As will be discussed below, the design of the inner slider 124 is such that the transition between the nested configuration and the separated configuration is designed to be fast and substantially effortless to allow the user to transition between different types of tricks seamlessly.

As shown in FIGS. 4-7, the outer housing 126 includes a sidewall 132 coupled to a bottom wall 134 at a lower end 136 of the sidewall 132. The sidewall 132 extends upwardly, terminates at an upper end 138, and defines a large aperture 140. The upper end 138 includes a rounded ridge extending around the perimeter of the sidewall 132. The sidewall 132 and the bottom wall 134 also define an interior volume 142 of the outer housing 126. A step 144 (see FIG. 5) extends inwardly from an inner surface 146 of the sidewall 132 and upwardly from a top surface 148 of the bottom wall 134. The step 144 is located proximate to the lower end 136 of the sidewall 132 and circumscribes the perimeter of the interior volume 142. The bottom wall 134 also defines a centrally located string aperture 150 that extends entirely through the bottom wall 134.

Figure 6:
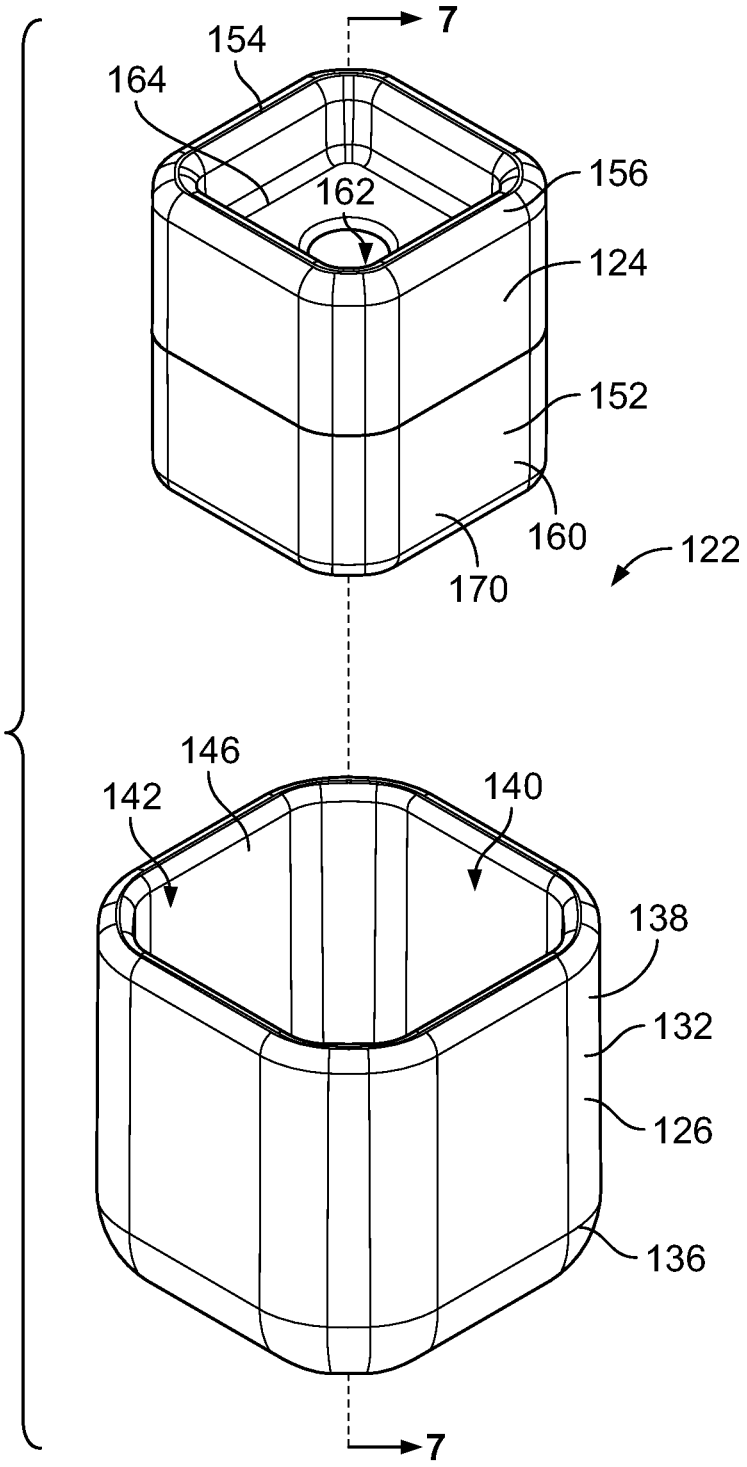
FIG. 6 is an exploded isometric view of the nested counterweight of FIG. 3.
Figure 7:
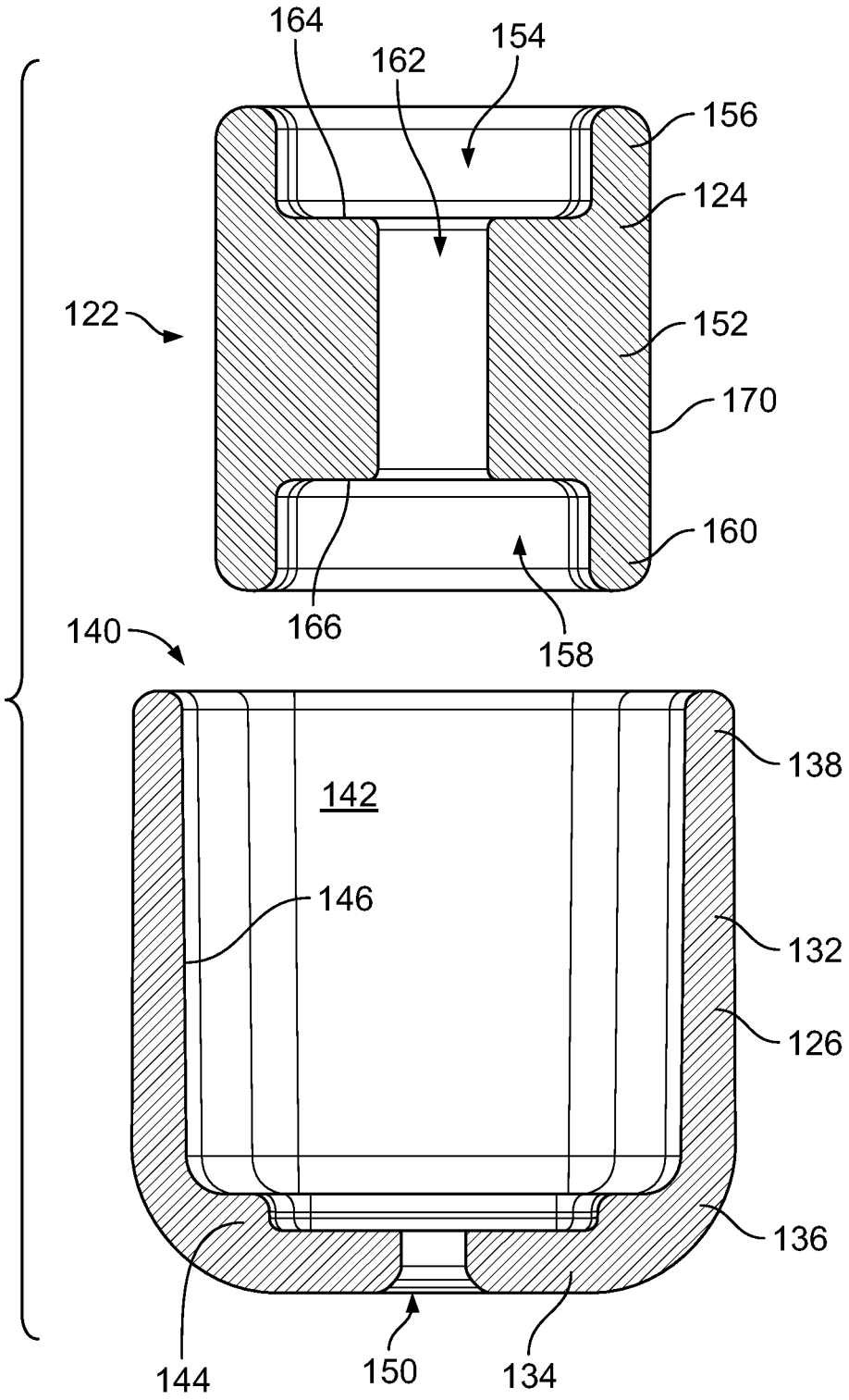
FIG. 7 is a exploded cross-sectional view of the nested counterweight of FIG. 3 taken along the line 7-7 of FIG. 6.

As best seen in FIGS. 5-7, the inner slider 124 includes a substantially cube shaped body 152 having a first recess 154 formed in a first end 156 and a second recess 158 formed in a second end 160, opposite the first end 156. The body 152 of the inner slider 124 is sized such that it corresponds to and fits within the interior volume 142 of the outer housing 126. In the embodiment depicted, the first recess 154 and the second recess 158 have a substantially similar profile. Additionally, a centrally positioned channel 162 extends through the body 152 from a first bottom surface 164 of the first recess 154 to a second bottom surface 166 of the second recess 158.

As depicted in FIG. 5, when the inner slider 124 is in the nested configuration within the interior volume 142 of the outer housing 126, at least one of the first end 156 or the second end 160 of the inner slider 124 is positioned on and contacts the step 144. The channel 162 of the inner slider 124 is generally or substantially aligned with the string aperture 150 of the outer housing 126. The body 152 of the inner slider 124 is sized such that a gap 168 is formed between an outer surface 170 of the inner slider 124 and the inner surface 146 of the sidewall 132 of the outer housing 126. It is contemplated that the gap 168 may extend around the entire perimeter of the outer surface 170 of the inner slider 124. In some embodiments, the gap 168 may only extend around a portion of the perimeter of the outer surface 170 of the inner slider. It is contemplated that the size of the gap 168 is an indicator of the difference in size of the interior volume 142 of the outer housing 126 and the size of the inner slider 124. Increasing the difference in the sizes may impact the ease in transitioning between the separated configuration and the nested configuration.

Referring now to FIGS. 8-10, the nested counterweight 122 is depicted with the string 110 passing through the nested counterweight 122 in both the nested configuration and the separated configuration. The string 110 passes through the string aperture 150 in the bottom surface of the outer housing 126 and into the channel 162 on the inner slider 124. It is contemplated that the channel 162 may be slightly larger in diameter than the string aperture 150 to allow for easier sliding along the length of the string 110. The small diameter of the string aperture 150 also allows the knot 128 in the string 110 to be smaller to retain the outer housing 126 at the end of the string 110.

The upper end 138 of the outer housing 126 of the outer housing 126 and both the first end 156 and the second end 160 of the inner slider 124 include smooth curved surfaces. The smooth curved surfaces, along with the sizing of the body 152 of the inner slider 124, allow for fast and smooth transitions between the nested configuration and the separated configuration. In one embodiment, any surfaces or transitions between surfaces that might have the string 110 rubbing or sliding across the surface during the use of the yo-yo 120 is smooth and/or curved. The smooth curved surfaces help prevent wear on the string 110 while the user is performing different maneuvers.

It is contemplated that the nested counterweight 122 may be constructed from a wide variety of materials and by various methods known to one of ordinary skill in the art. In one embodiment, a counterweight is about one-seventh of the mass of the rotating mass of the yo-yo 120. With a nested counter weight, it is contemplated that both the inner slider 124 and the outer housing 126 are each one-seventh of the mass of the rotating mass of the yo-yo 120. By varying the materials that comprise the nested counterweight 122, the size and dimensions of the counterweight 122 may change relative to the rest of the yo-yo 120 to maintain the ratio of the mass of the counterweight 122 to the mass of the yo-yo 120. The present design allows for flexibility in changing the size of various attributes of the inner slider 124 and the outer housing 126 to accommodate different materials. For example, the embodiment depicted may be formed from various types of injected molded plastics. Other embodiments may be formed from different materials such as metal, wood, or 3-D printed materials. By adjusting the size of the recesses of the inner slider 124 and the thickness of the sidewall 132 of the outer housing 126, it is possible to adapt the nested counterweight 122 to maintain the preferred mass ratio.

It is also contemplated that the shape of the inner slider 124 and the outer housing 126 may be any complementary pair. The inner slider 124 need only be sized to fit within the interior volume 142 of the outer housing 126. It is also contemplated that the outer housing 126 may be configured in a first geometric shape and the inner slider 124 may be configured in a second geometric shape that correlates to the first geometric shape of the outer housing 126 so that the inner slider 124 may be positioned within the interior volume 142 of the outer housing 126 in a nested configuration.

Figure 11:
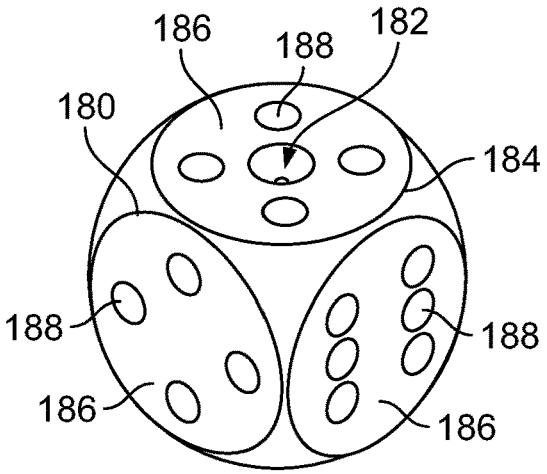
FIG. 11 is an isometric view of another embodiment of a counterweight.
Figure 12:
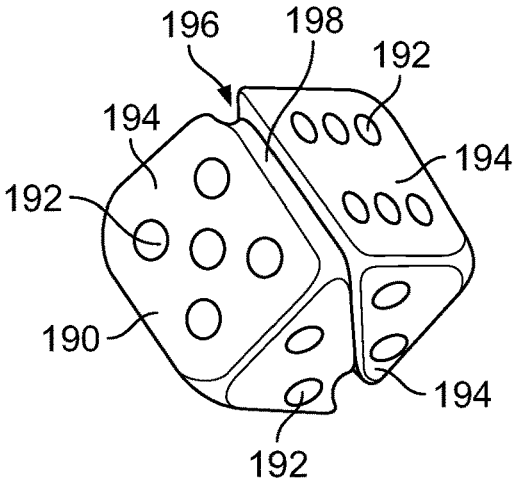
FIG. 12 is an isometric view of yet another embodiment of a counterweight.
Figure 13:
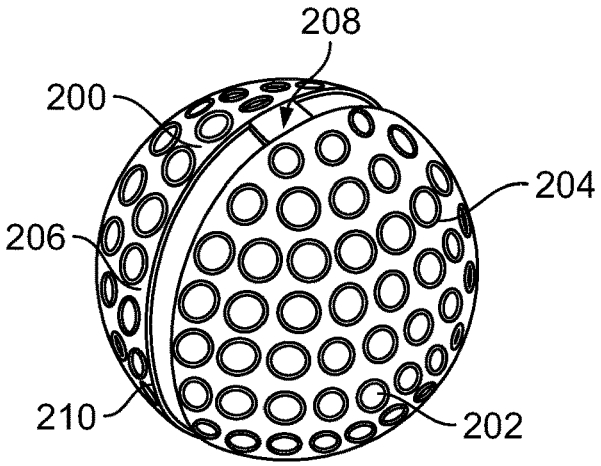
FIG. 13 is an isometric view of a further embodiment of a counterweight.

Some examples of different geometric shapes for the inner slider 124 are depicted as counterweights 180, 190, and 200 in FIGS. 11-13. It is contemplated that the outer housing 126 and the inner slider 124 may take any number of different geometric shape combinations with the only limitation that the inner slider 124 must fit within the outer housing 126 in a nested configuration. In some instances, the inner slider 124 is disposed entirely within the outer housing 126 in a nested configuration. It is also contemplated that the outer surfaces of the outer housing 126 and the inner slider 124 may include surface indicia or indentations/texturing to give both the outer housing 126 and the inner slider 124 an appearance of a different object. Some examples of this are depicted in FIGS. 11-13. One having ordinary skill in the art would understand the variety of ways that the inner slider 124 could be shaped to be received in the interior volume 142 of the outer housing 126.

Referring back to FIGS. 1 and 2, the rotatable performance device or yo-yo 100 generally includes the inner lobe spacers 102, the bearing assembly 104, the outer lobes 106, and the axle 108 that comprise the rotating body of the yo-yo 100. The string 110 connects to the bearing assembly 104 at one end the opposing end passes through the nested counterweight 122 as described above and depicted in FIGS. 3 and 8-10. It is contemplated that there are several methods by which the nested counterweight may be used during the performance of and transitions between different maneuvers.

A first maneuver is performed while the nested counterweight 122 is grasped in a user's first hand in a nested configuration and connected via the string 110 to the rotating body of the yo-yo 100. To transition from a first maneuver to a second maneuver the inner slider 124 is released from the interior volume 142 of the outer housing 126. The inner slider 124 is permitted to slide down the string 110 by repositioning the outer housing 126 above the inner slider 124 and allowing gravity to pull the inner slider 124 down. The user may then grasps the inner slider 124 with a second hand. While the outer housing 126 is grasped in the user's first hand and the inner slider 124 is grasped in the user's second hand, the second maneuver is performed with the yo-yo 100.

Other methods and transitions are also contemplated using the nested counterweight 122. A user may transition from the second maneuver discussed above to a third maneuver by releasing the outer housing 126 and allowing it to swing on the end of the string 110 while maintaining a grasp of the inner slider 126. After releasing the outer housing 126, a third maneuver may be performed.

A further method of transitioning from the third maneuver to a fourth maneuver may be as follows. More specifically, the outer housing 126 is grasped by a user with a first hand and the inner slider 126 may be repositioned into the interior volume 142 of the outer housing 126 and the fourth maneuver may be performed. It is also contemplated that there are multiple methods of transitioning from the maneuver positions as described above.

Another method of transitioning from the second maneuver to a fifth maneuver is as follows. The outer housing 126 is released from the first hand and the inner slider 124 is released from the second hand simultaneously. Then, the outer housing 126 may be grasped by the second hand and the inner slider 124 is grasped by the first hand, generally simultaneously, and the fifth maneuver is then performed.

Another method of transitioning from a second maneuver to a sixth maneuver is as follows. The inner slider 124 is released from the second hand of the user, the user grasps the string 110, and the sixth maneuver is performed. It is contemplated that there are many possible methods of use for the nested counterweight not specifically disclosed herein. One having ordinary skill in the art would understand the vast variety of ways that a user may grasp the inner slider 124 and the outer housing 126 to perform different maneuvers and transitions between maneuvers.

Now turning to FIGS. 11-13, several different embodiments of counterweights are depicted. A counterweight 180 depicted in FIG. 11 includes a central passage 182 that that extends through a body 184. The body 184 includes various surfaces 186 that give the counterweight 180 the general appearance of a casino die. Each surface 186 includes shallow dimples 188 that mimic one face of the die.

FIG. 12 shows a counterweight 190 having a similar appearance to the counterweight 180 in that it also has the general appearance of a casino die with dimples 192 on surfaces 194. The counterweight 190 is different from the counterweight 180 in that a passage 196 extends from opposing corners instead of through two of the surfaces 186 as on the counterweight 180. The counterweight 190 also includes a channel 198 around a perimeter of the counterweight 190.

FIG. 13 depicts a counterweight 200 having a body 202 formed to resemble a golf ball with dimples 204 in an outer surface 206. A passage 208 extends through the body 202 of the counterweight 200. A channel 210 is formed in the outer surface 206 of the body 202 and extends around the perimeter of the body 202. It is contemplated that the counterweights 180, 190, 200 may be used as an inner sliding counterweight with a complementary outer housing (not shown) or as a single counterweight. It is also contemplated that the channels 198, 210 may be used for wrapping the string or tether around the counterweights 190, 200 for storage or during the use of a yo-yo.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

INDUSTRIAL APPLICABILITY

A nested counterweight that provides fast and easy transitions between a nested configuration and a separate configuration is presented. A user may transition between maneuvers with a rotatable performance device that require either a single counterweight or two counterweights when equipped with the nested counterweight of the present disclosure.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

I claim:

1. A nested counterweight for a rotatable performance device, the nested counterweight comprising:

an outer housing defining an interior volume and configured to be positioned along a string of the rotatable performance device; and an inner slider configured to be positioned along the string of the rotatable performance device, wherein the inner slider is positioned within the interior volume of the outer housing in a nested configuration and the inner slider is positioned along the string away from the outer housing in a separated configuration, wherein the inner slider is defined by a cube shaped body and includes a first recess and a second recess on opposing sides thereof.

2. The nested counterweight of claim 1, wherein the outer housing includes a sidewall and a bottom wall that define the interior volume.

3. The nested counterweight of claim 2, wherein the bottom wall defines a string aperture configured to permit the outer housing to slide along the string.

4. The nested counterweight of claim 3, wherein the inner slider includes a channel configured to permit the inner slider to slide along the string between the nested configuration and the separated configuration.

5. The nested counterweight of claim 4, wherein the string aperture of the outer housing substantially aligns with the channel of the inner slider when the inner slider in the nested configuration.

6. The nested counterweight of claim 1, wherein a mass of the outer housing and the inner slider combined is about one-seventh of a mass of the rotatable performance device.

7. The nested counterweight of claim 1, wherein the outer housing is retained on the string by a knot or a loop in a first end of the string and the rotatable performance device coupled to a second end of the string.

8. The nested counterweight of claim 1, wherein the inner slider is positionable at any location along a length of the string in the separated configuration between being adjacent the outer housing to being adjacent a body of the rotatable performance device.

9. The nested counterweight of claim 1, wherein a portion of the inner slider contacts a portion of the outer housing when the inner slider is in the nested configuration.

10. The nested counterweight of claim 1, wherein a gap is defined between an outer surface of the inner slider and an inner surface of the outer housing when the inner slider is positioned in the nested configuration.

11. The nested counterweight of claim 10, wherein the gap extends around a perimeter of the inner slider.

12. A nested counterweight for a rotatable performance device, the nested counterweight comprising:

an outer housing configured in a first geometric shape, the outer housing defining an interior volume and configured to be positioned along a string of the rotatable performance device; and an inner slider movable along the string and configured in a second geometric shape that correlates to the first geometric shape of the outer housing so that the inner slider may be positioned within the interior volume of the outer housing in a nested configuration, wherein the inner slider includes a first recess and a second recess on opposing sides thereof, and wherein the string is a single portion of tether that passes only once through a centrally positioned channel of the inner slider.

13. The nested counterweight of claim 12, wherein the first geometric shape is generally a cube with an opening on one side, and the second geometric is generally an enclosed cube with a through hole for the string.

14. The nested counterweight of claim 12, wherein the outer housing includes an exterior surface with texturing or surface indicia.

15. The nested counterweight of claim 14, wherein the texturing or surface indicia of the exterior surface of the outer housing give the appearance of one of a golf ball or die.

16. The nested counterweight of claim 12 further including a string designed to be attached to a yo-yo.

17. The nested counterweight of claim 12, wherein the outer housing further includes an interior step that is designed to contact the inner slider when the inner slider is in a nested configuration.

18. The nested counterweight of claim 12, wherein the inner slider is defined by a cube shaped body with a centrally positioned channel extending through the body.

19. The nested counterweight of claim 18, wherein the body of the inner slider is sized such that a gap is formed between an outer surface of the inner slider and an inner surface of the outer housing.

20. A method of using a nested counterweight with a rotatable performance device, comprising:

providing the nested counterweight including an outer housing and an inner slider, the outer housing defining an interior volume configured to receive the inner slider, and the inner slider defining a first recess and a second recess on opposing sides thereof;

positioning the outer housing and the inner slider along a string of the rotatable performance device; and sliding the inner slider away from the outer housing to perform a maneuver with the rotatable performance device such that the nested counterweight is in a separated configuration whereby the outer housing is not in contact with the inner slider.

21. A nested counterweight for a rotatable performance device, the nested counterweight comprising:

an outer housing configured in a first geometric shape, the outer housing defining an interior volume and configured to be positioned along a string of the rotatable performance device; and an inner slider movable along the string and configured in a second geometric shape so that the inner slider may be positioned within the interior volume of the outer housing in a nested configuration, wherein the inner slider is defined by a cube shaped body having a first recess and a second recess on opposing sides thereof with a centrally positioned channel extending through the body.

22. The nested counterweight of claim 21, wherein the outer housing includes an exterior surface with texturing or surface indicia.

23. The nested counterweight of claim 22, wherein the texturing or surface indicia of the exterior surface of the outer housing give the appearance of one of a golf ball or die.

24. The nested counterweight of claim 21 further including a string designed to be attached to a yo-yo.

25. The nested counterweight of claim 21, wherein the outer housing further includes an interior step that is designed to contact the inner slider when the inner slider is in a nested configuration.

26. The nested counterweight of claim 21, wherein the body of the inner slider is sized such that a gap is formed between an outer surface of the inner slider and an inner surface of the outer housing.

* * * * *